US008894390B2

(12) United States Patent
Hsu

(10) Patent No.: US 8,894,390 B2
(45) Date of Patent: Nov. 25, 2014

(54) INFLATABLE AND DEFLATABLE AIR PUMP

(75) Inventor: Hao Hsu, Guang Dong (CN)

(73) Assignee: Dongguan Haohan Shangmao Ltd., Dong Guan, Guang Dong (CA)

( * ) Notice: Subject to any disclaimer, the term of this patent is extended or adjusted under 35 U.S.C. 154(b) by 290 days.

(21) Appl. No.: 13/388,497

(22) PCT Filed: Nov. 11, 2009

(86) PCT No.: PCT/CN2009/074886

§ 371 (c)(1),
(2), (4) Date: Feb. 2, 2012

(87) PCT Pub. No.: WO2011/022898

PCT Pub. Date: Mar. 3, 2011

(65) Prior Publication Data

US 2012/0128515 A1 May 24, 2012

(30) Foreign Application Priority Data

Aug. 25, 2009 (CN) ..... 2009 2 0204278 U

(51) Int. Cl.

| | |
|---|---|
| ***F04B 35/04*** | (2006.01) |
| ***F04D 25/08*** | (2006.01) |
| ***F04D 13/06*** | (2006.01) |
| ***F04D 15/00*** | (2006.01) |
| ***F04D 25/10*** | (2006.01) |
| ***F04D 17/08*** | (2006.01) |
| ***F04D 17/10*** | (2006.01) |
| ***F04D 25/06*** | (2006.01) |
| ***A47C 27/08*** | (2006.01) |

(52) U.S. Cl.

CPC ..... *F04D 25/084* (2013.01); *F04D 13/06* (2013.01); *F04D 15/0005* (2013.01); *F04D 25/10* (2013.01); *F04D 15/0016* (2013.01); *F04D 17/08* (2013.01); *F04D 17/10* (2013.01); *F04D 25/06* (2013.01); *A47C 27/082* (2013.01)

USPC ..... 417/423.14; 417/423.1; 417/410.3

(58) Field of Classification Search

CPC ..... F04D 17/08; F04D 17/10; F04D 25/06; F04D 1/00; F04D 13/06; F04D 15/0005; F04D 15/0016; F04D 15/0027; F04D 25/10; F04D 25/12; F04D 20/403; F04D 13/16; F04D 19/04; F47C 27/00

USPC ..... 417/423.1, 308, 423.14, 410.3; 251/310, 311

See application file for complete search history.

(56) References Cited

U.S. PATENT DOCUMENTS 5,983,940 A * 11/1999 Smith ..... 137/625.22
6,733,254 B1 * 5/2004 Yen ..... 417/423.1

(Continued)

*Primary Examiner* — Bryan Lettman
*Assistant Examiner* — Timothy P Solak
(74) *Attorney, Agent, or Firm* — McClure, Qualey & Rodack, LLP

(57) ABSTRACT

An inflatable and deflatable air pump includes a panel, a panel cover matched with the panel, an air chamber installed inside of the panel cover, a motor connected with the air chamber, and a hollow cylindrical shifting switch. A plurality of air inlet-outlet holes are formed on the panel, a vent valve is disposed on the panel cover, an impeller is disposed in the air chamber and is connected thereto with a rotating shaft of the motor, and two air chamber holes are formed on the air chamber. The shifting switch is connected with a connecting linkage, and the connecting linkage is connected with a driving switch, two radial through holes perpendicular to each other and two radial half through holes perpendicular to each other are formed on the shifting switch, and a protruding stopping element is disposed on the shifting switch.

8 Claims, 8 Drawing Sheets

(56) References Cited

U.S. PATENT DOCUMENTS 6,832,629 B2 * 12/2004 Wu ..... 137/625.21
2003/0037839 A1 * 2/2003 Song et al. ..... 141/317
2004/0202559 A1 * 10/2004 Yen ..... 417/423.1
2006/0073012 A1 * 4/2006 Song et al. ..... 415/206

* cited by examiner

INFLATABLE AND DEFLATABLE AIR PUMP

CROSS-REFERENCE TO RELATED APPLICATION

This application is a co-pending application which claims priority to PCT Application No. PCT/CN2009/074886, filed Nov. 11, 2009 entitled "Inflatable and Deflatable Air Pump", herein incorporated by reference in its entirety. This application also claims priority to, and the benefit of, Chinese patent application no. 200920204278.5, filed Aug. 25, 2009, herein incorporated by reference in its entirety.

FIELD OF THE INVENTION

The present invention relates to an air pump, and in particular relates to an inflatable and deflatable air pump.

DESCRIPTION OF THE RELATED ART

In our daily lives, inflatable products have gradually become popular, such as air beds, air sofas, and air boats, etc. These inflatable products are cheap, convenient, and easy to be carried, which are favored by a lot of consumers.

Conventional inflatable and deflatable air pumps utilize a structure moving leftward-rightward or upward-downward on a plane as a switch to control pump inflation and pump deflation. Conventional structures are complex, expensive, and they deteriorate easily with time.

PROBLEM TO BE SOLVED

The present invention provides an inflatable and deflatable air pump to overcome the complex and deterioration problems of the conventional art.

PROBLEM SOLUTION

An inflatable and deflatable air pump is provided. The inflatable and deflatable air pump includes a panel, a panel cover matched with the panel, an air chamber installed inside of the panel cover, a motor connected with the air chamber, and a hollow cylindrical shifting switch. A plurality of air inlet-outlet holes are formed on the panel, a vent valve is disposed on the panel cover, an impeller is disposed in the air chamber and is connected thereto with a rotating shaft of the motor, and two air chamber holes are formed on the air chamber. The shifting switch is connected with a connecting linkage, and the connecting linkage is connected with a driving switch, two radial through holes perpendicular to each other and two radial half through holes perpendicular to each other are formed on the shifting switch, and a protruding stopping element is disposed on the shifting switch.

Compared to the conventional inflatable and deflatable air pumps utilizing the structure moving leftward-rightward or upward-downward on a plane as a switch to control pump inflation and pump deflation, the inflatable and deflatable air pump of the embodiment of the invention controls pump inflation and pump deflation by rotating the shifting switch. The inflatable and deflatable air pump of the invention has a simple structure, reduced costs and improved reliability.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

First Embodiment

Figure 1A:
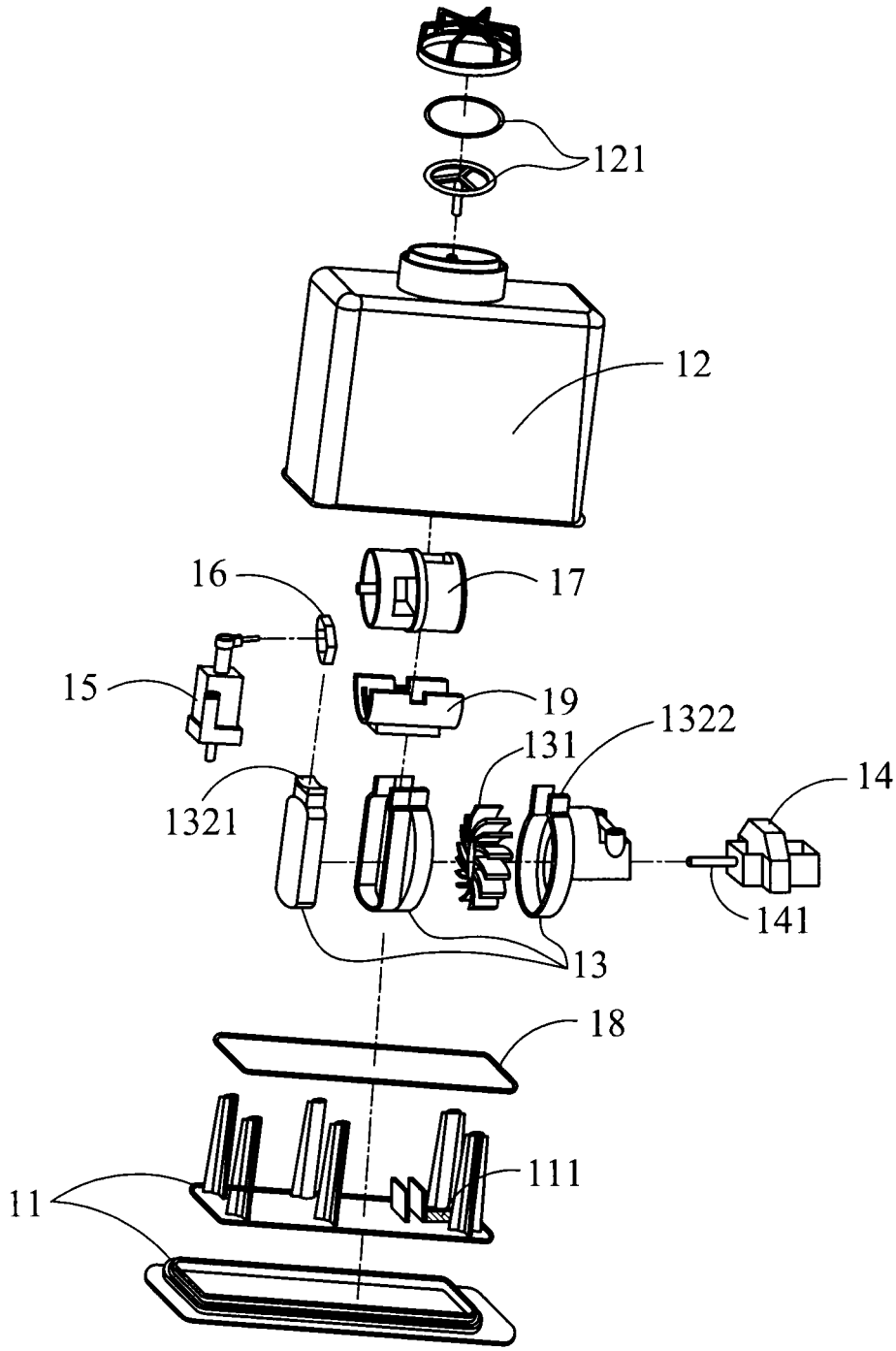
FIG. 1A is an exploded view of an inflatable and deflatable air pump of a first embodiment of the invention.
Figure 1B:
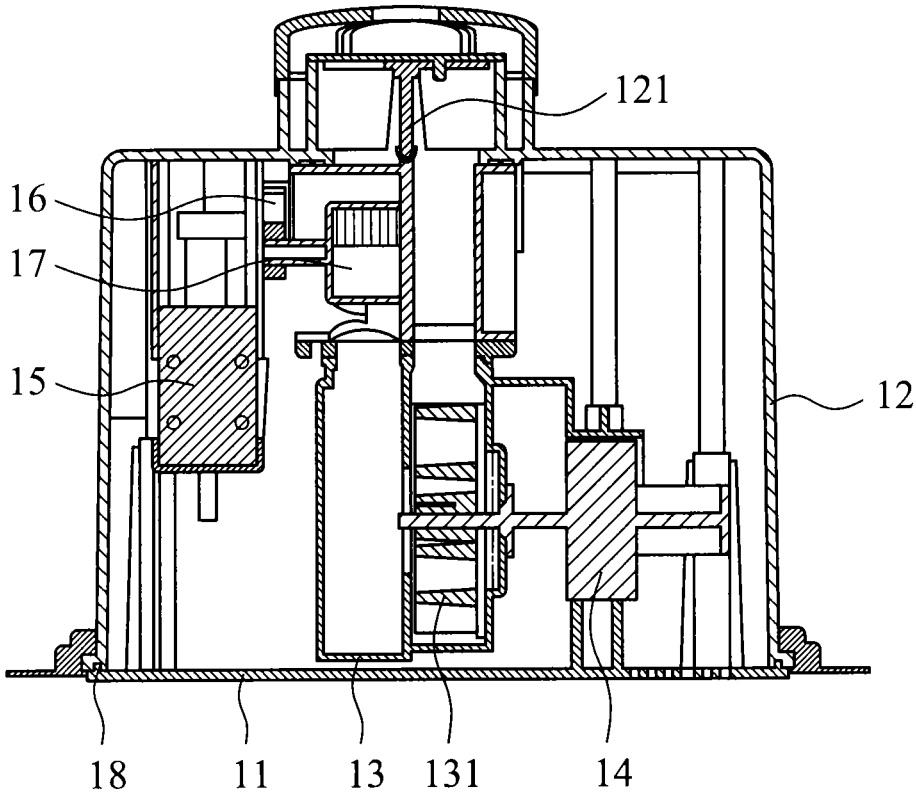
FIG. 1B is an assembly view of the inflatable and deflatable air pump of the first embodiment of the invention.
Figure 1C:
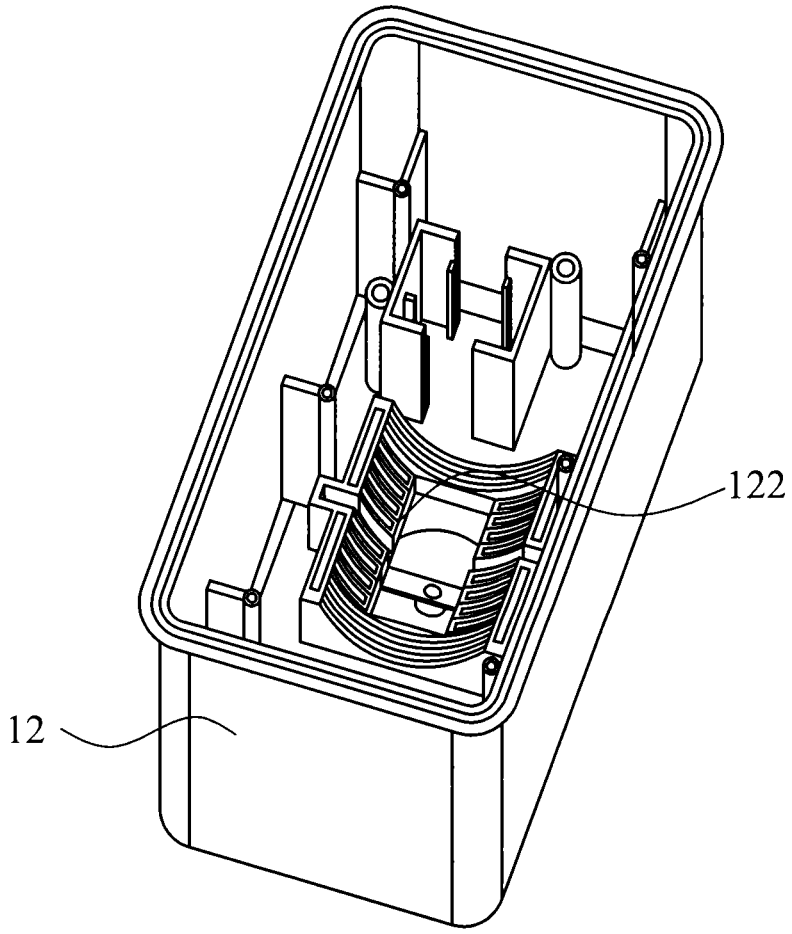
FIG. 1C shows a panel cover of the first embodiment of the invention.
Figure 1D:
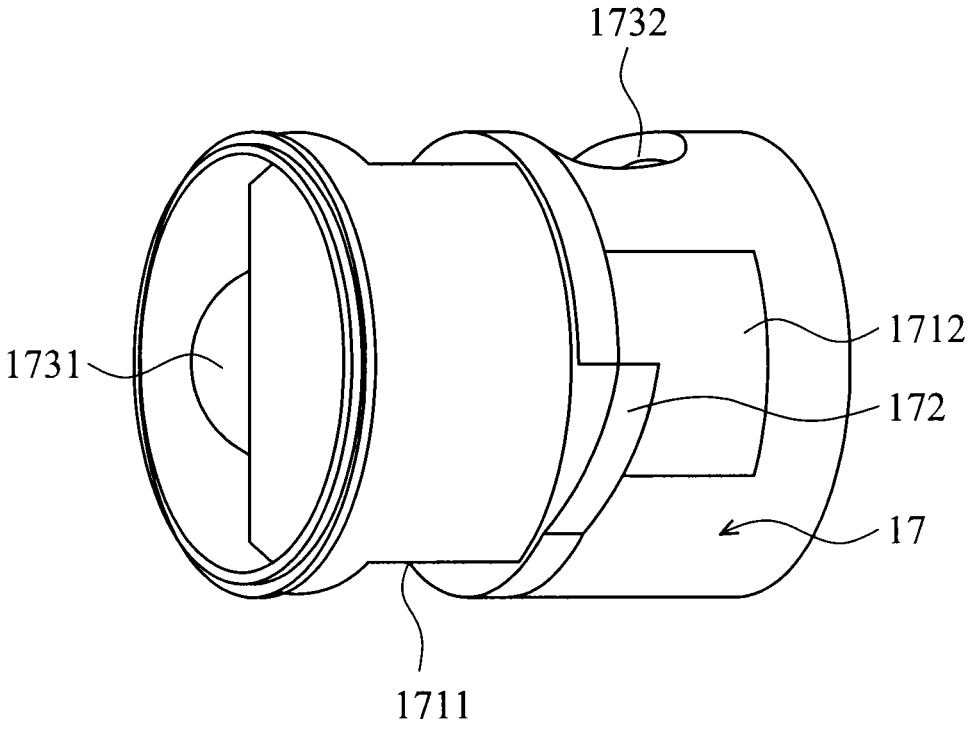
FIG. 1D shows a shifting switch of the first embodiment of the invention.

FIGS. 1A, 1B, 1C and 1D show an inflatable and deflatable air pump of a first embodiment of the invention, which includes a panel 11, a panel cover 12 matched with the panel 11, an air chamber 13 installed inside of the panel cover 12, a motor 14 connected with the air chamber 13, and a hollow cylindrical shifting switch 17. A plurality of air inlet-outlet holes 111 are formed on the panel 11. A vent valve 121 is disposed on the panel cover 12. An impeller 131 is disposed in the air chamber 13 and is connected thereto with a rotating shaft 141 of the motor 14. Two air chamber holes 1321, 1322 are formed on the air chamber 13. The shifting switch 17 is connected with a connecting linkage 16, and the connecting linkage 16 is connected with a driving switch 15. Two radial through holes 1711, 1712 perpendicular to each other and two radial half through holes 1731, 1732 perpendicular to each other are formed on the shifting switch 17. A protruding stopping element 172 is disposed on the shifting switch 17.

In one embodiment, a seal ring 18 is sandwiched between the panel 11 and the panel cover 12 to improve airtightness between the panel 11 and the panel cover 12.

In one embodiment, the shifting switch 17 is disposed in a receiving recess 122 inside of the panel cover 12, and is fixed to the panel cover 12 by a shell 19.

Also in one embodiment, the driving switch 15 is disposed on a side of the air chamber 13. The driving switch 15 is an electric driving switch, which is activated by electricity. The driving switch 15 rotates the shifting switch 17 via the connecting linkage 16. The protruding stopping element 172 restricts the shifting switch to only rotate clockwise or counterclockwise within a range of 90 degrees. When the shifting switch 17 is in an initial orientation, the through hole 1712 of the shifting switch 17 communicates the air chamber hole 1322 with the vent valve 121, the half through hole 1731 communicates the air chamber hole 1321 with outer air, and the other through hole 1711 and the other half through hole 1732 are sealed. When the shifting switch 17 is rotated by 90 degrees, the through hole 1711 of the shifting switch 17 communicates the air chamber hole 1321 with the vent valve 121, the half through hole 1732 communicates the air chamber hole 1322 with the outer air, and the other through hole 1712 and the other half through hole 1731 are sealed.

The first embodiment of the invention provides an operation method for the inflatable and deflatable air pump:

(1) In an inflating state, the motor 14 is activated. The motor 14 rotates the impeller 131 inside of the air chamber 13, and impels air to low pass the half through hole 1731 and the air chamber hole 1321 to the air chamber 13. The air flow then exits the inflatable and deflatable air pump via the air chamber hole 1322 and the through hole 1712. In the inflating state, the vent valve 121 is opened automatically allowing air flow to push air into the air product for inflation.

(2) In a deflating state, the motor 14 and the driving switch 15 are activated simultaneously. The motor 14 rotates the impeller 131 inside of the air chamber 13, the driving switch 15 rotates the connecting linkage 16, the connecting linkage 16 rotates the shifting switch by 90 degrees, the protruding stopping element 172 of the shifting switch 17 opens the vent valve 121, and the through hole 1711 communicates the vent valve 121 with the air chamber hole 1321 of the air chamber. Air inside of the air product passes through the vent valve 121, through hole 1711 and the air chamber hole 1321 into the air chamber 13, and exits the inflatable and deflatable air pump via the half through hole 1732 and the air chamber hole 1322 to deflate the air product.

(3) When the air pump is shut down, the motor 14 is shut down, the driving switch 15 shifts back to the initial position, the shifting switch 17 shifts back to the initial position, and the vent valve 121 is closed automatically.

Second Embodiment

Figure 2A:
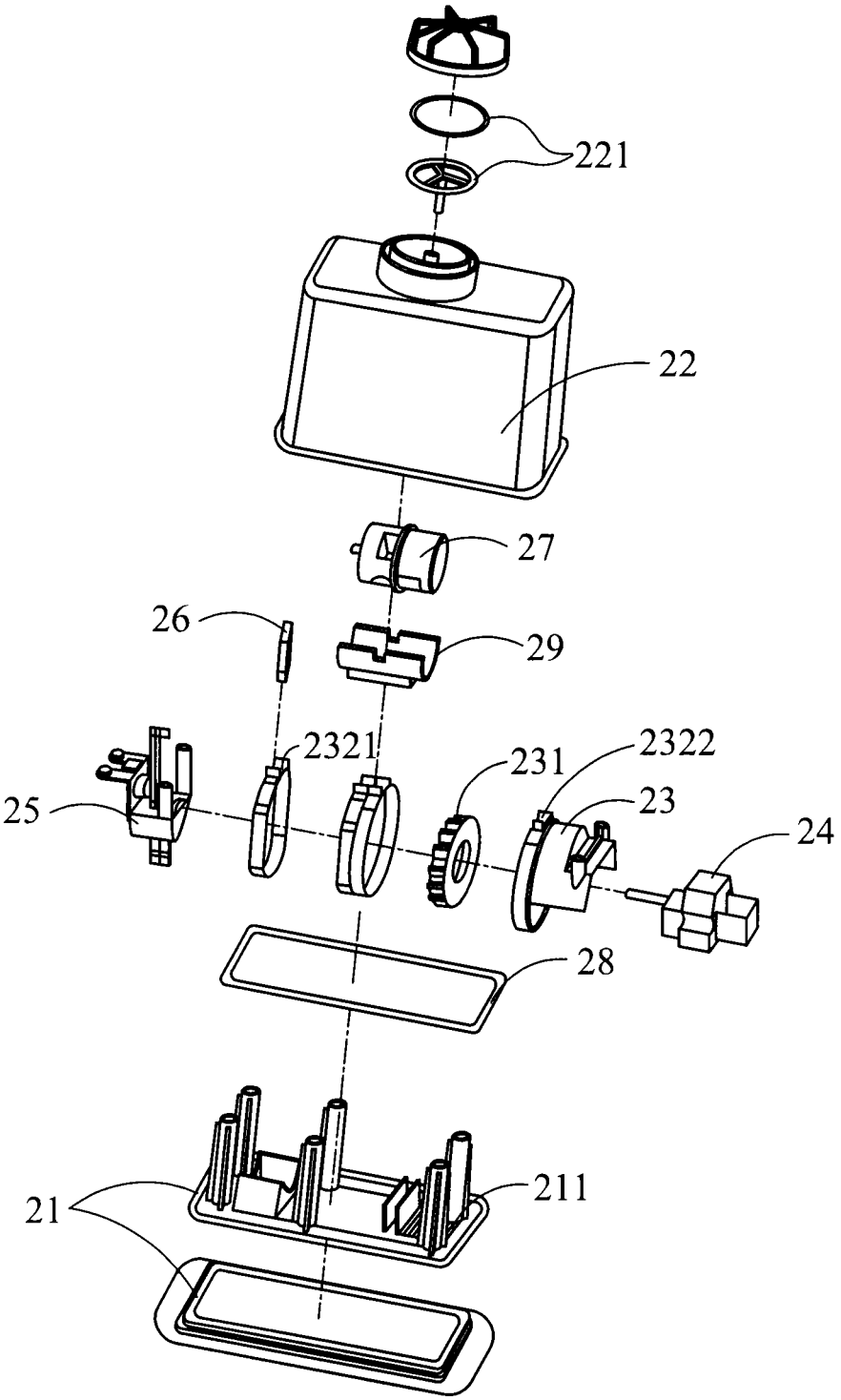
FIG. 2A is an exploded view of an inflatable and deflatable air pump of a second embodiment of the invention.
Figure 2B:
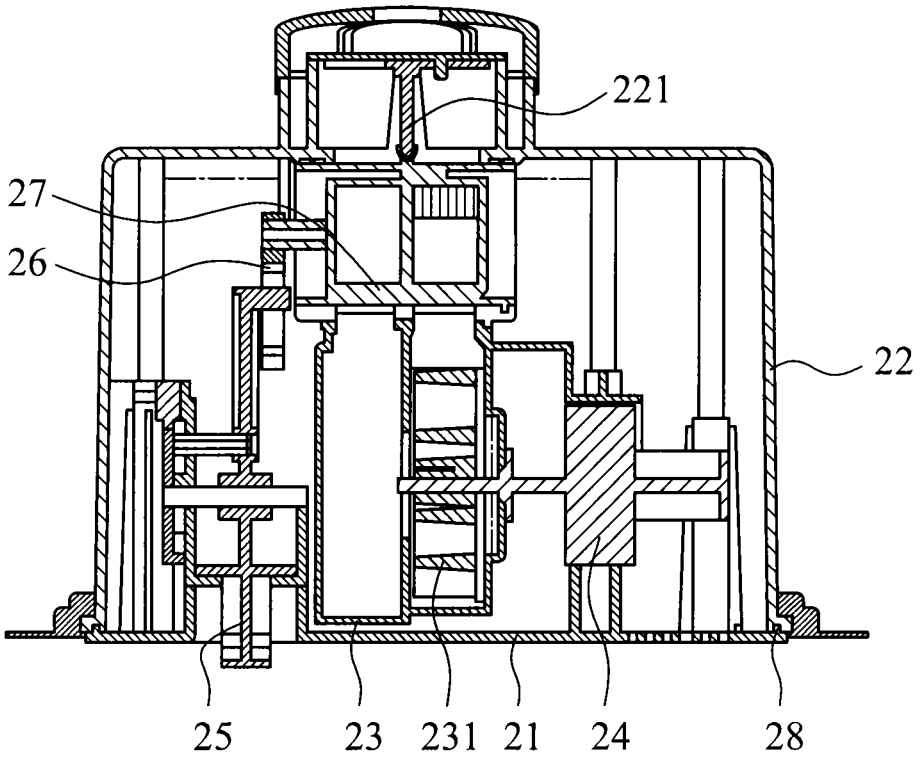
FIG. 2B is an assembly view of the inflatable and deflatable air pump of the second embodiment of the invention.
Figure 2C:
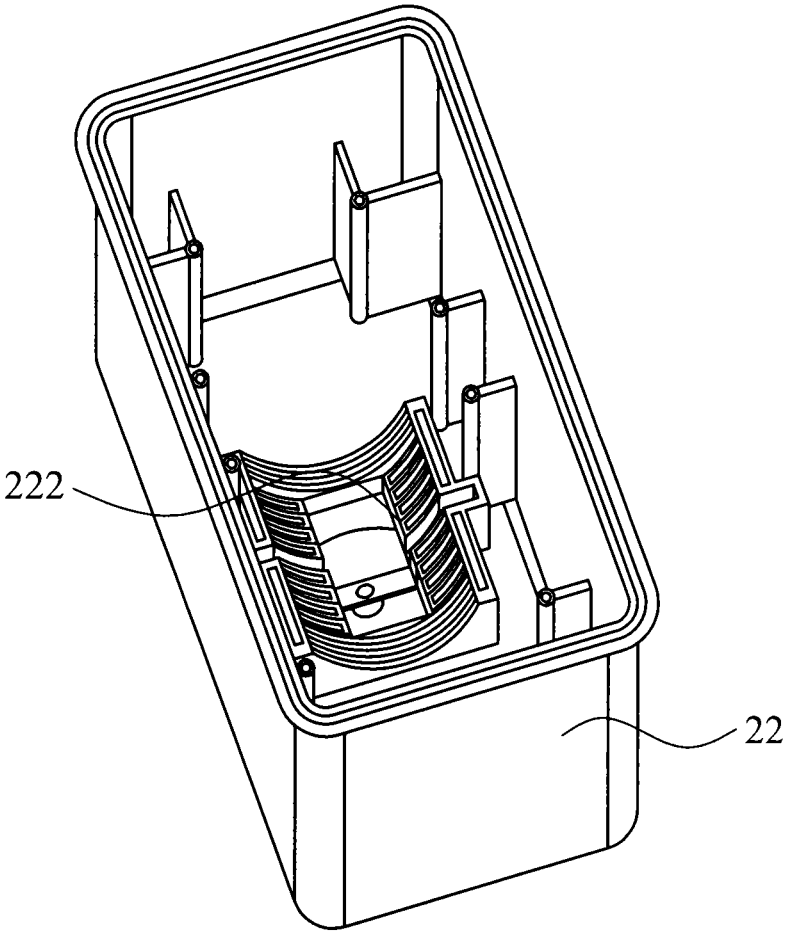
FIG. 2C shows a panel cover of the second embodiment of the invention.
Figure 2D:
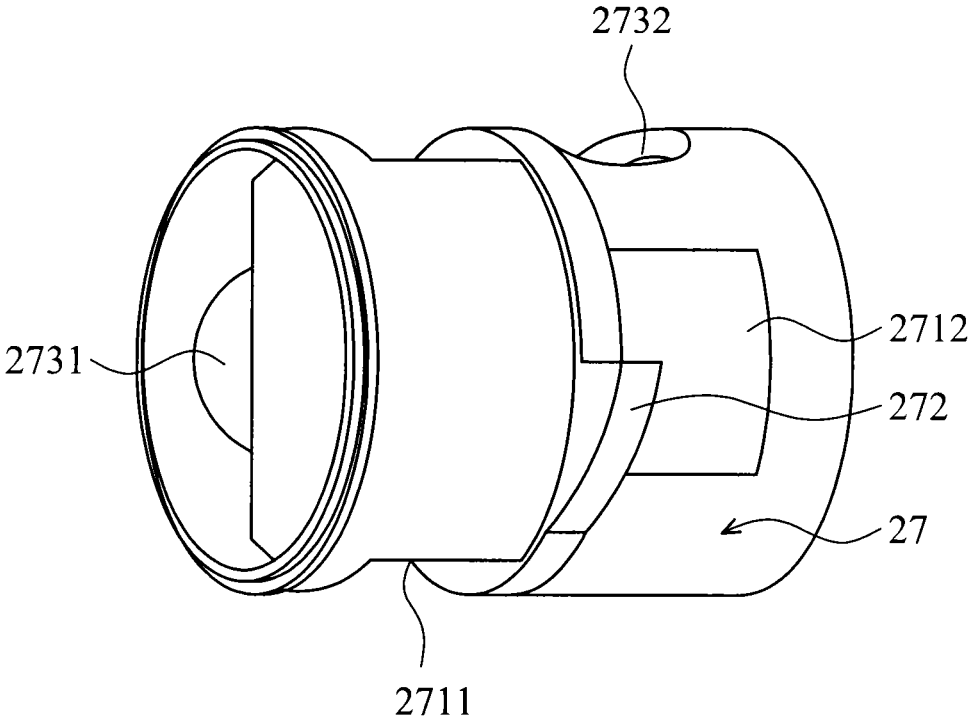
FIG. 2D shows a shifting switch of the second embodiment of the invention.

FIGS. 2A, 2B, 2C and 2D show an inflatable and deflatable air pump of a second embodiment of the invention, which includes a panel 21, a panel cover 22 matched with the panel 21, an air chamber 23 installed inside of the panel cover 22, a motor 24 connected with the air chamber 23, and a hollow cylindrical shifting switch 27. A plurality of air inlet-outlet holes 211 are formed on the panel 21. A vent valve 221 is disposed on the panel cover 22. An impeller 231 is disposed in the air chamber 23 and is connected thereto with a rotating shaft 241 of the motor 24. Two air chamber holes 2321, 2322 are formed on the air chamber 23. The shifting switch 27 is connected with a connecting linkage 26, and the connecting linkage 26 is connected with a driving switch 25. Two radial through holes 2711, 2712 perpendicular to each other and two radial half through holes 2731, 2732 perpendicular to each other are formed on the shifting switch 27. A protruding stopping element 272 is disposed on the shifting switch 27.

In concrete, a seal ring 28 is sandwiched between the panel 21 and the panel cover 22 to improve airtightness between the panel 21 and the panel cover 22.

In one embodiment, the shifting switch 27 is disposed in a receiving recess 222 inside of the panel cover 22, and is fixed to the panel cover 22 by a shell 29.

Also in one embodiment, the driving switch 25 is disposed on a side of the air chamber 23. The driving switch 25 is a manual driving switch, which is rotated by manpower. The driving switch 25 rotates the shifting switch 27 via the connecting linkage 26. The protruding stopping element 272 restricts the shifting switch 27 rotated clockwise or counterclockwise within the range of 90 degrees. When the shifting switch 27 is rotated clockwise from an initial orientation for 45 degrees, the through hole 2712 of the shifting switch 27 communicates the air chamber hole 2322 with the vent valve 221, the half through hole 2731 communicates the air chamber hole 2321 with the outer air, and the other through hole 2711 and the other half through hole 2732 are sealed. When the shifting switch 27 is rotated counterclockwise from the initial orientation for 45 degrees, the through hole 2711 of the shifting switch 27 communicates the air chamber hole 2321 with the vent valve 221, the half through hole 2732 communicates the air chamber hole 2322 with the outer air, and the other through hole 2712 and the other half through hole 2731 are sealed.

In the second embodiment, the manual driving switch 25 is utilized to inflate and deflate an air bed or air sofa. When the driving switch 25 is pushed upward by hand, the air pump is switched to an inflating state. When the driving switch 25 is pushed downward by hand, the air pump is switched to a deflating state. Compared to conventional air pumps which are switched by pushing the switch leftward or rightward, the driving switch 25 of the embodiment of the invention is easily operated without probability for operating errors.

The second embodiment of the invention provides an operation method for the inflatable and deflatable air pump:

(1) In the inflating state, the motor 24 is activated. The driving switch 25 is pushed upward to be rotated upward. The motor 24 rotates the impeller 231 inside of the air chamber 23. The driving switch 25 clockwise rotates the shifting switch 27 via the connecting linkage 26 for 45 degrees, the protruding stopping element 272 of the shifting switch 27 pushes the vent valve 221, and the air flow passes the half through hole 2731 and the air chamber hole 2321 to the air chamber 23. The air flow then enters the air product via the air chamber hole 2322 and the through hole 2712. In the inflating state, the vent valve 221 is opened by the protruding stopping element 272 of the shifting switch 27. Compared with the conventional air pump which opens the vent valve by air pressure, the air pump of the embodiment of the invention has improved reliability and safety.

(2) In a deflating state, the motor 24 is activated. The motor 24 rotates the impeller 231 inside of the air chamber 23, and the driving switch 25 is pushed downward to be rotated downward. The driving switch 25 counterclockwise rotates the shifting switch 27 via the connecting linkage 26 for 45 degrees, the protruding stopping element 272 of the shifting switch 27 pushes the vent valve 221, the through hole 2711 of the shifting switch 27 communicates the vent valve 221 with the air chamber hole 2321 of the air chamber 23. The half through hole 2732 communicates the air chamber hole 2322 with the air chamber 23 to outer air to deflate the air product. Compared with the conventional air pump, in the air pump of the embodiment of the invention, the rotation angle of the manual switch (driving switch 25) is decreased, and is more convenient to use.

(3) When the air pump is shut down, the motor 24 is shut down, the driving switch 25 is pushed back to the initial position, and the vent valve 121 is closed thereby.

Compared to conventional inflatable and deflatable air pumps utilize a structure moving leftward-rightward or upward-downward on a plane as a switch to control pump inflation and pump deflation, the embodiments of the invention control pump inflation and pump deflation by rotating the shifting switch, which has a simple structure, decreased costs, and improved reliability.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inflatable and deflatable air pump, comprising a panel, a panel cover matched with the panel, an air chamber installed inside of the panel cover, a motor connected with the air chamber, wherein a plurality of air inlet-outlet holes are formed on the panel, a vent valve disposed on the panel cover, an impeller disposed in the air chamber and connected thereto with a rotating shaft of the motor, and two air chamber holes formed on the air chamber, which is characterized in that the inflatable and deflatable air pump further comprises a hollow cylindrical shifting switch, wherein the shifting switch is connected with a connecting linkage, and the connecting linkage is connected with a driving switch, two radial through holes perpendicular to each other and two radial half through holes perpendicular to each other, formed on the shifting switch, and a protruding stopping element is disposed on the shifting switch, wherein the air chamber holes comprise a first air chamber hole and a second air chamber hole, the radial through holes comprise a first through hole and a second through hole, the radial half through holes comprise a first half through hole and a second half through hole, wherein when the shifting switch is in an initial orientation, the second through hole of the shifting switch communicates the second air chamber hole with the vent valve, the first half through hole communicates the first air chamber hole with outer air, and the other first through hole and the other second half through hole are sealed, and when the shifting switch is rotated by 90 degrees, the first through hole of the shifting switch communicates the first air chamber hole with the vent valve, the second half through hole communicates the second air chamber hole with the outer air, and the other second through hole and the other first half through hole are sealed.

2. The inflatable and deflatable air pump as claimed in claim 1, characterized in that a seal ring is sandwiched between the panel and the panel cover.

3. The inflatable and deflatable air pump as claimed in claim 1, characterized in that the shifting switch is disposed in a receiving recess inside of the panel cover, and is fixed to the panel cover by a shell.

4. The inflatable and deflatable air pump as claimed in claim 1, characterized in that the driving switch is disposed on a side of the air chamber.

5. The inflatable and deflatable air pump as claimed in claim 1, characterized in that the driving switch is rotated by an external force, and the driving switch rotates the shifting switch via the connecting linkage, and the protruding stopping element restricts the shifting switch to only rotate within a range of 90 degrees.

6. The inflatable and deflatable air pump as claimed in claim 5, characterized in that the driving switch is a manual driving switch.

7. The inflatable and deflatable air pump as claimed in claim 5, characterized in that the driving switch is an electric driving switch.

8. The inflatable and deflatable air pump as claimed in claim 1, wherein the motor is enclosed by the panel and the panel cover.

* * * * *